US009700999B2

(12) United States Patent
Hsieh

(10) Patent No.: US 9,700,999 B2
(45) Date of Patent: Jul. 11, 2017

(54) FAST TORQUE-ADJUSTABLE TORQUE WRENCH

(71) Applicant: KABO TOOL COMPANY, Taichung (TW)

(72) Inventor: Chih-Ching Hsieh, Taichung (TW)

(73) Assignee: KABO TOOL COMPANY, Taichung (TW)

( * ) Notice: Subject to any disclaimer, the term of this patent is extended or adjusted under 35 U.S.C. 154(b) by 395 days.

(21) Appl. No.: 14/222,902

(22) Filed: Mar. 24, 2014

(65) Prior Publication Data

US 2015/0239109 A1 Aug. 27, 2015

(30) Foreign Application Priority Data

Feb. 21, 2014 (TW) ..... 103105951 A

(51) Int. Cl.
*B25B 23/142* (2006.01)

(52) U.S. Cl.
CPC ..... *B25B 23/1427* (2013.01)

(58) Field of Classification Search
CPC ... B25B 23/1427; B25B 23/141; B25B 23/14; B25B 23/1422; B25B 17/00
See application file for complete search history.

(56) References Cited

U.S. PATENT DOCUMENTS 4,541,313 A * 9/1985 Wise ..... B25B 23/1427 81/478
4,870,879 A * 10/1989 Shieh ..... B25B 23/1427 81/483
6,945,144 B1 9/2005 Cutler
7,000,508 B2 * 2/2006 Li ..... B25B 23/1427 81/467
7,044,036 B1 * 5/2006 Salazar ..... B25B 23/1427 81/478
8,495,935 B2 * 7/2013 Mountz ..... G01L 5/24 81/467
2003/0159552 A1 8/2003 Hsieh
2009/0320654 A1 * 12/2009 Wu ..... B25B 23/1427 81/478

FOREIGN PATENT DOCUMENTS

WO 9404321 3/1994
WO WO 2011005892 1/2011

* cited by examiner

*Primary Examiner* — Robert Scruggs
(74) *Attorney, Agent, or Firm* — Guice Patents PLLC

(57) ABSTRACT

A torque-adjustable torque wrench includes: a tubular body; a flexible bar, an abutment member and a compression spring disposed in the tubular body, a front end of the compression spring abutting against the abutment member; a head section connected with a front end of the flexible bar; an adjustment rod disposed in the tubular body; and an adjustment switch rotatably fitted on a rear end of the tubular body and connected with a rear end of the adjustment rod. The elastic force of the compression spring against the abutment member is adjustable by rotating the adjustment switch. The adjustment switch is only rotatable within a rotational range of one circle, in such rotational range, the ratio of the maximum adjustable torque value to the minimum adjustable torque value of the wrench ranges from 1.2 to 10 times.

7 Claims, 10 Drawing Sheets

FAST TORQUE-ADJUSTABLE TORQUE WRENCH

BACKGROUND OF THE INVENTION

1. Field of the Invention

The present invention relates generally to a hand tool, and more particularly to a torque wrench.

2. Description of the Related Art

FIG. 1 shows a conventional mechanical torque wrench 10. The shank body 12 of the torque wrench 10 is formed with a window 13. A scale plate 14 is disposed in the shank body 12. The scales 15 of the scale plate 14 can be seen through the window 13. A handle 16 is rotatably disposed at a rear end of the shank body 12. Scales 17 are disposed on a circumference of the handle 16. The torque value of the wrench is adjustable by means of rotating the handle 16. When rotating the handle 16, the scale plate 14 is indirectly driven by the handle 16 to move. A user can read the scales 15, 17 to find the set torque value of the wrench. The torque value is read in a manner similar to that of a caliper.

FIG. 2 shows another conventional mechanical torque wrench 20. The shank body 22 of the torque wrench 20 is marked with scales 25. The torque value of the wrench 20 is adjustable by means of rotating the handle 26. When rotating the handle 26, the handle 26 is also axially moved along the shank body 22. A user can read the scales 27 marked on the handle 26 and the scales 25 aligned with the front end of the handle 26 to find the set torque value of the wrench.

Both the above conventional torque wrenches cannot be quickly adjusted in torque value. Also, it is inconvenient to adjust the torque value of the conventional torque wrenches. For example, the torque value can be increased or decreased by 10 Nm by means of rotating the handle 16 or 26 by one circle. Therefore, it is necessary to rotate the handle by six circles for adjusting the torque value of the wrench by 60 Nm. There are several often used torque values in many sites such as an automobile service shop where several torque values are often used for the tire of an automobile. The torque values are frequently switched in the automobile service shop. The conventional torque wrenches cannot be quickly adjusted in torque value so that it is inconvenient to use the conventional torque wrenches.

In addition, the scales 15, 25 of the conventional torque wrenches are too small to clear see. Moreover, the conventional torque wrenches are marked with different units of scales such as Nm of international unit, lb-ft of British system and kg-m of metric system. These scales of different units are densely arranged so that it is hard for a user to clearly identify the torque values. In conversion between different units, the user often guesses or adjusts the torque value of the wrench to an approximate range without precisely setting a true torque value.

According to the above, the conventional torque wrench has the shortcomings that the torque cannot be quickly adjusted and it is hard to read the torque value.

SUMMARY OF THE INVENTION

It is therefore a primary object of the present invention to provide a mechanical torque wrench, which can be quickly adjusted in torque value.

It is a further object of the present invention to provide the above torque wrench, which is designed with a specific range of torque values. The torque of the wrench can be quickly and precisely adjusted to several often used values.

It is still a further object of the present invention to provide the above torque wrench, on which the scales of torque values can be clearly identified.

The fast torque-adjustable torque wrench of the present invention includes:

a tubular body;

a flexible bar pivotally disposed at the front end of the tubular body and swingtable, a rear end of the flexible bar being positioned in the tubular body; a head section being fixedly connected with a front end of the flexible bar;

an abutment member and a compression spring disposed in the tubular body, the abutment member being positioned behind the flexible bar; a front end of the compression spring elastically abutting against the abutment member; a detachment mechanism formed between the rear end of the flexible bar and the front end of the abutment member; and a torque adjustment mechanism including an adjustment rod and an adjustment switch, the adjustment rod being disposed in the tubular body and being formed with a threaded rod section; the adjustment switch being rotatably disposed at the rear end of the tubular body and connected with a rear end of the adjustment rod, whereby when rotating the adjustment switch, the adjustment rod is rotated along with the adjustment switch to adjust the elastic force of the compression spring against the abutment member.

The adjustment switch of the invention is only rotatable within a rotational range of one circle. In the rotational range of the adjustment switch, the wrench has a minimum adjustable torque value and a maximum adjustable torque value within the rotational range of the adjustment switch. The ratio of the maximum adjustable torque value to the minimum adjustable torque value ranges from 1.2 times to 10 times.

Accordingly, the set torque value of the wrench can be quickly adjusted by means of rotating the adjustment switch.

Preferably, a restriction member and a restriction annular groove are respectively disposed on an outer circumference of the tubular body and an inner circumference of the adjustment switch. One end of the restriction member is inlaid in the restriction annular groove. The restriction member and the restriction annular groove cooperate with each other to restrict the rotational angle of the adjustment switch within a range of 360 degrees.

Preferably, the ratio of the maximum adjustable torque value to the minimum adjustable torque value is achieved by means of the elastic coefficient of the compression spring or the pitch of the threaded rod section or the multiplication effect of the elastic coefficient of the compression spring and the pitch of the threaded rod section.

The present invention can be best understood through the following description and accompanying drawings, wherein:

DETAILED DESCRIPTION OF THE PREFERRED EMBODIMENTS

Figure 1:
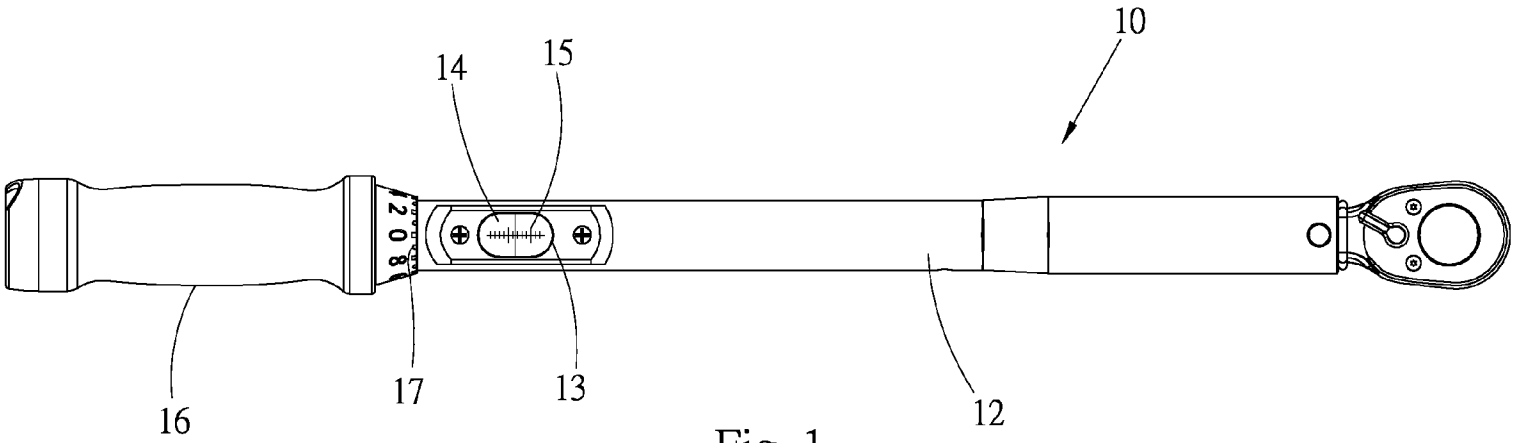
Fig. 1 PRIOR ART
FIG. 1 is a top view of a conventional torque wrench.
Figure 2:
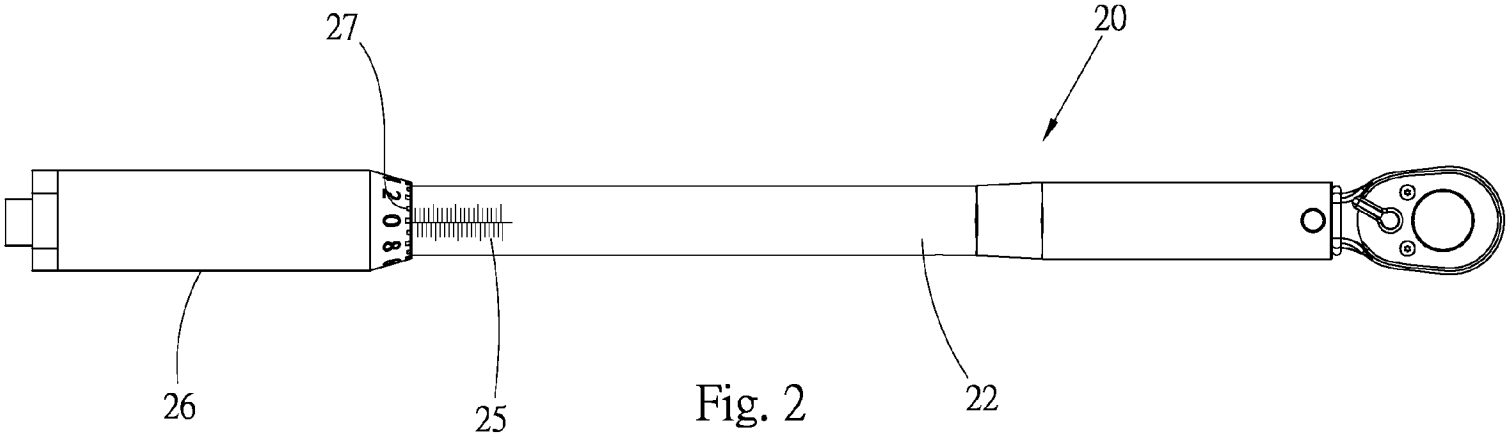
Fig. 2 PRIOR ART
FIG. 2 is a top view of another conventional torque wrench.
Figure 3:
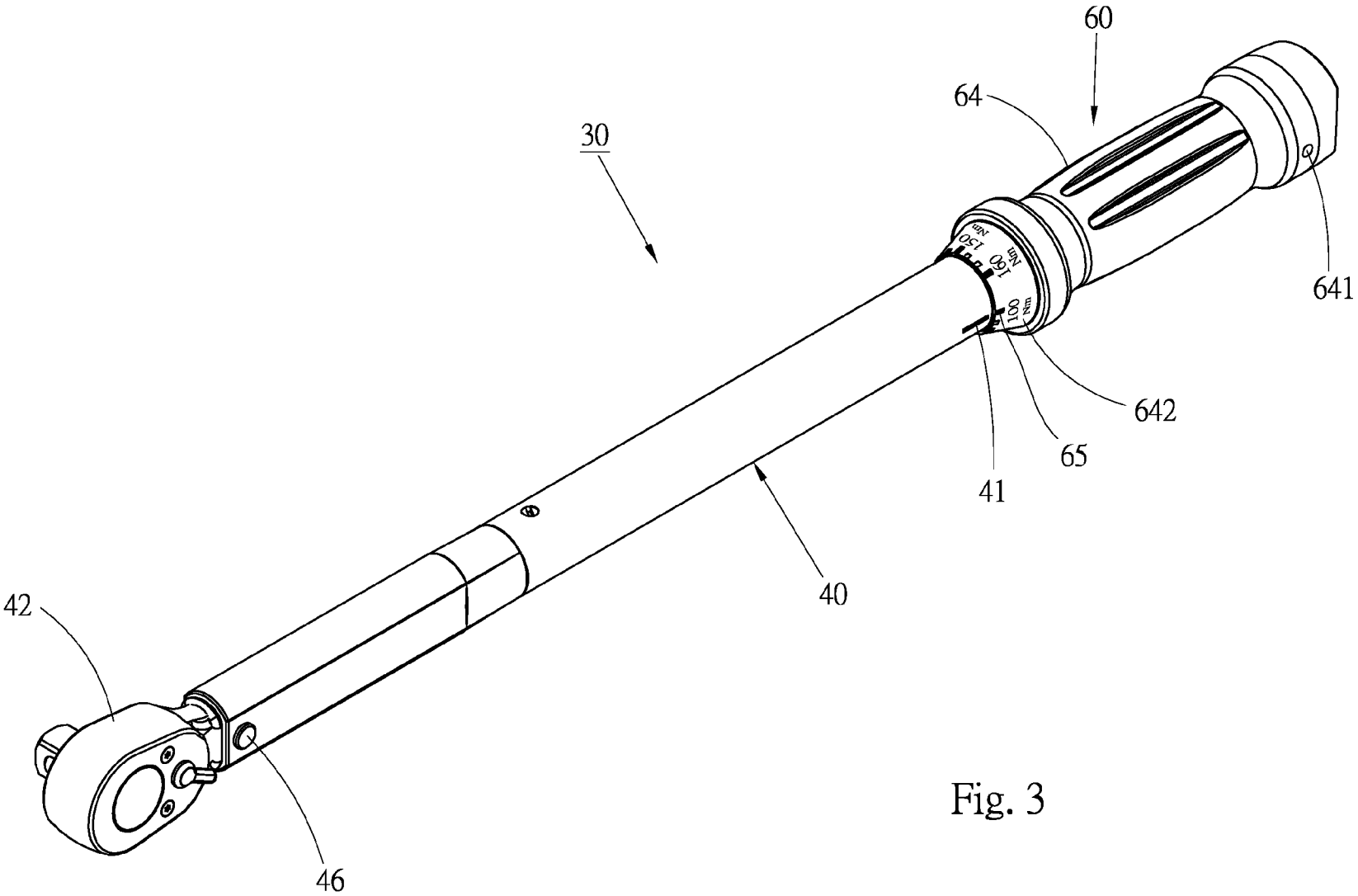
FIG. 3 is a perspective view of a first embodiment of the torque wrench of the present invention.
Figure 4:
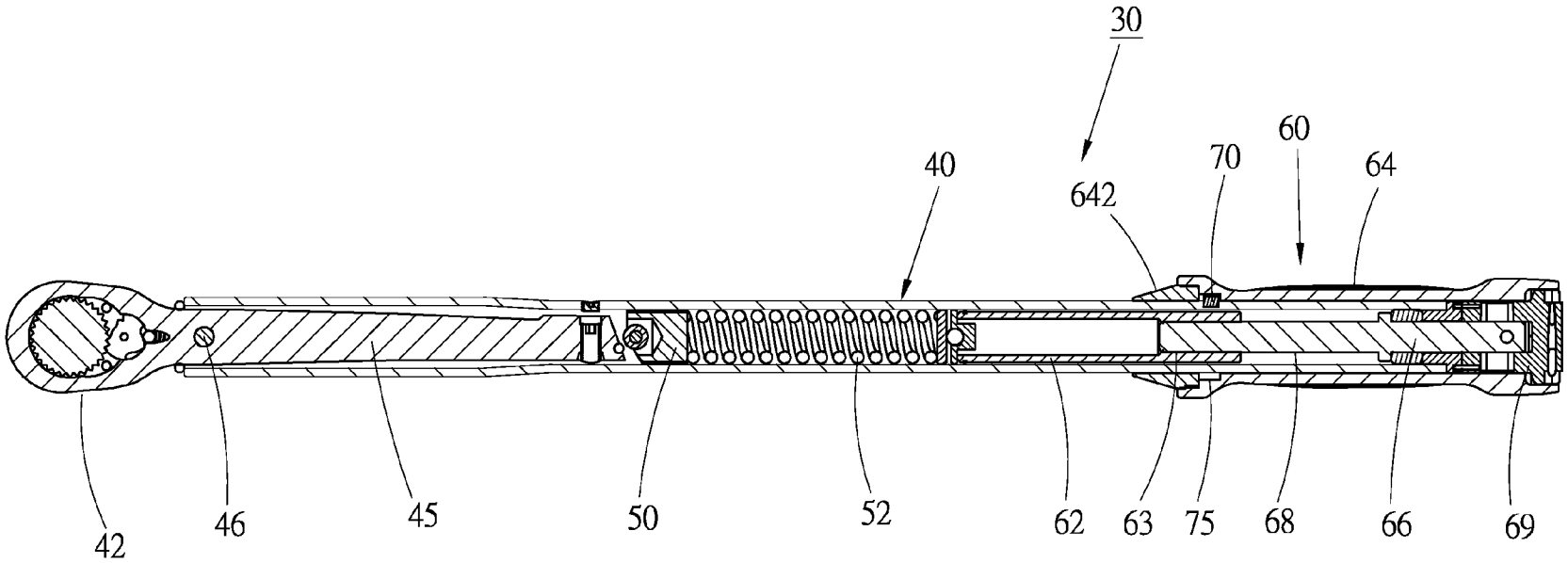
FIG. 4 is a longitudinal sectional view of the first embodiment of the torque wrench of the present invention.
Figure 5:
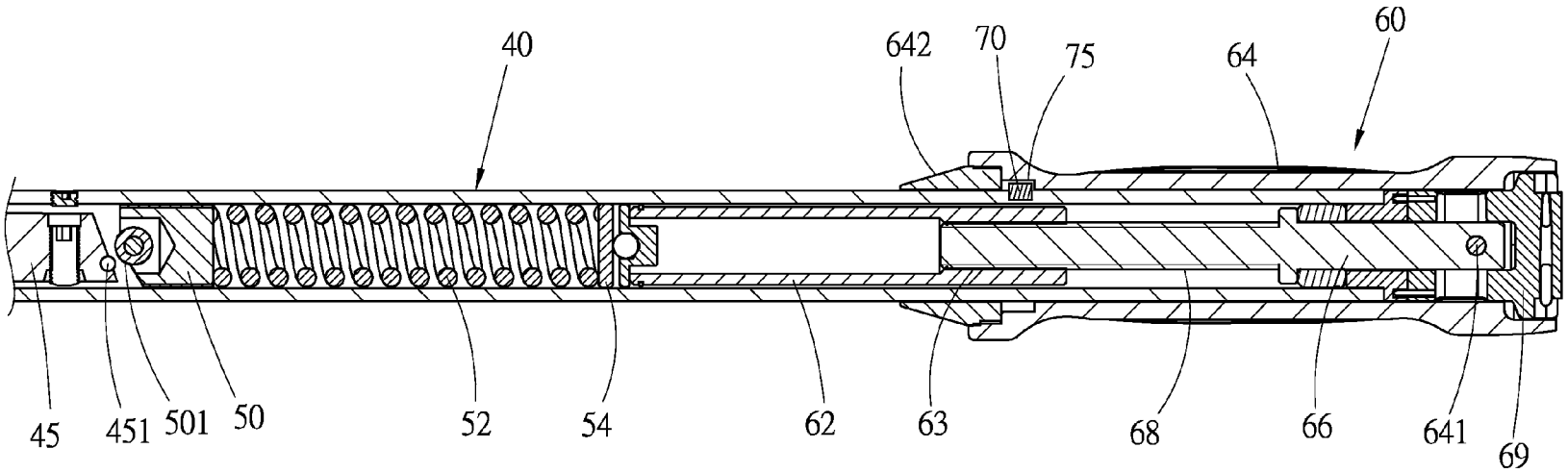
FIG. 5 is an enlarged view of a part of FIG. 4.

Please refer to FIGS. 3 to 5. According to a first embodiment, the torque wrench 30 of the present invention is a torque wrench with a mechanical structure.

Figure 10:
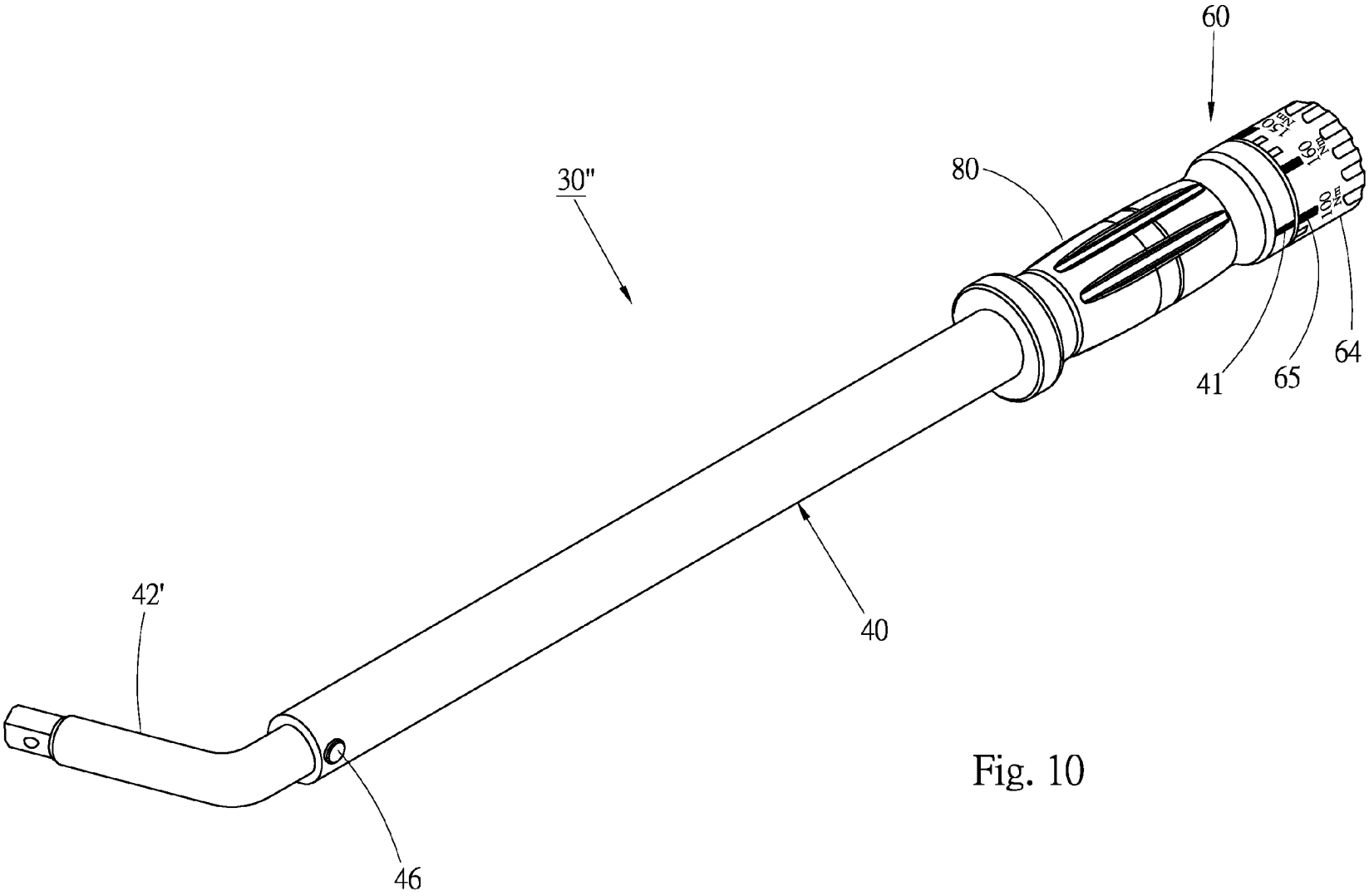
FIG. 10 is a perspective view of a third embodiment of the torque wrench of the present invention.

The wrench 30 has a tubular body 40 and a head section 42 positioned at a front end of the tubular body 40. The head section 42 of the wrench 30 can be fitted with a threaded member (such as a bolt or a nut) or a socket to wrench the threaded member. The structural form of the head section is not limited to that disclosed in the specification. FIGS. 3 and 10 respectively show two wrenches 30, 30" with two types of head sections 42, 42'. A flexible bar 45 is pivotally disposed at the front end of the tubular body 40 via pivot pin 46 and is swingtable around the pivot pin 46. A rear end of the flexible bar 45 is positioned in the tubular body 40. The head section 42 is fixedly disposed at a front end of the flexible bar 45. An indicator 41 is disposed on a circumference of the tubular body 40.

An abutment member 50, a compression spring 52 and a slide member 62 are sequentially disposed in the tubular body 40 from the front end to the rear end. The abutment member 50 is slidable within the tubular body and positioned behind the flexible bar 45. The slide member 62 is slidable within the tubular body 40 without possibility of rotation. The slide member is formed with an internal threaded hole 63. The compression spring 52 is positioned between the abutment member 50 and the slide member 62. A front end of the compression spring 52 elastically abuts against the abutment member. A front end of the slide member 62 abuts against a rear end of the spring 52 via a small circular disc 54. The compression spring 52 serves to make the abutment member 50 elastically contact the rear end of the flexible bar 45. A protrusion section 501 is disposed at the front end of the abutment member 50. A protrusion section 451 is disposed at the rear end of the flexible bar 45. The abutment member 50 and the flexible bar 45 are structurally designed as a detachment mechanism. In use of the wrench 30, when the torque is greater than a set torque value, (that is, greater than the elastic energy of the spring 52), the protrusion section 451 of the rear end of the flexible bar 45 will detach from the protrusion section 501 of the front end of the abutment member 50 to make a shock and sound for warning an operator to stop operating. The detachment mechanism of the torque wrench pertains to prior art. Various conventional detachment mechanisms have been disclosed. For example, FIG. 11 discloses another type of detachment mechanism. Various detachment mechanisms are applicable to the present invention. The detachment mechanism of the present invention is not limited to the above embodiment.

The present invention further includes a torque adjustment mechanism 60. The torque adjustment mechanism 60 includes the above slide member 62, an adjustment switch 64 fitted around the rear end of the tubular body 40 and an adjustment rod 66 disposed in the tubular body 40. The adjustment rod 66 is only rotatable within the tubular body 40 and cannot be back and forth moved within the tubular body 40. At least a front section of the adjustment rod 66 is formed with a threaded rod section 68 having a thread screwed in the threaded hole 63 of the slide member 62. The adjustment switch 64 is also only rotatable around the tubular body 40 without possibility of displacement. A rear end of the adjustment switch 64 is directly or indirectly connected with the rear end of the adjustment rod 66, (for example, by means of an insertion pin 641). When rotating the adjustment switch 64, the adjustment rod 66 is rotated along with the adjustment switch 64. At this time, the threaded rod section 68 drives the slide member 62 to back and forth slide in an axial direction of the tubular body 40 between different positions. Accordingly, the elastic force of the compression spring 52 against the abutment member 50 is adjustable to set the torque value of the wrench 30. A collar 642 is mounted at the front end of the adjustment switch 64 as a part thereof. Several scales 65 are marked on a circumference of the collar. In this embodiment, the adjustment switch serves as a handle of the wrench.

An engagement member 69 is disposed at the rear end of the adjustment switch 64 and movable between an engagement position and a releasing position. When the engagement member 69 is positioned in the engagement position, the adjustment switch 64 cannot be rotated. Only when the engagement member is shifted to the releasing position, the adjustment switch 64 is rotatable for adjusting the torque value of the wrench. The engagement member pertains to prior art and thus will not be further described hereinafter.

Figure 6:
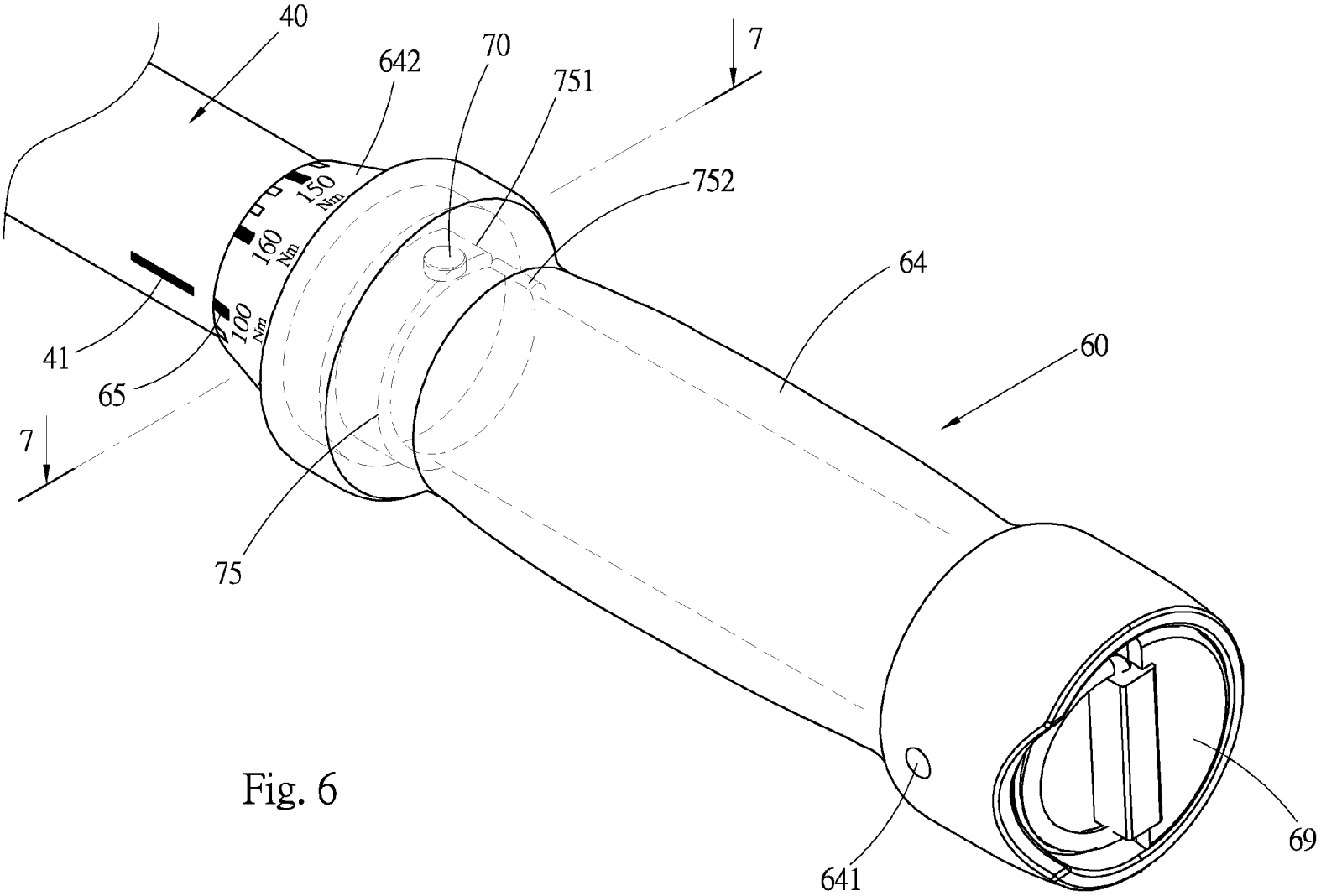
FIG. 6 is a perspective enlarged view of a part of FIG. 3.
Figure 7:
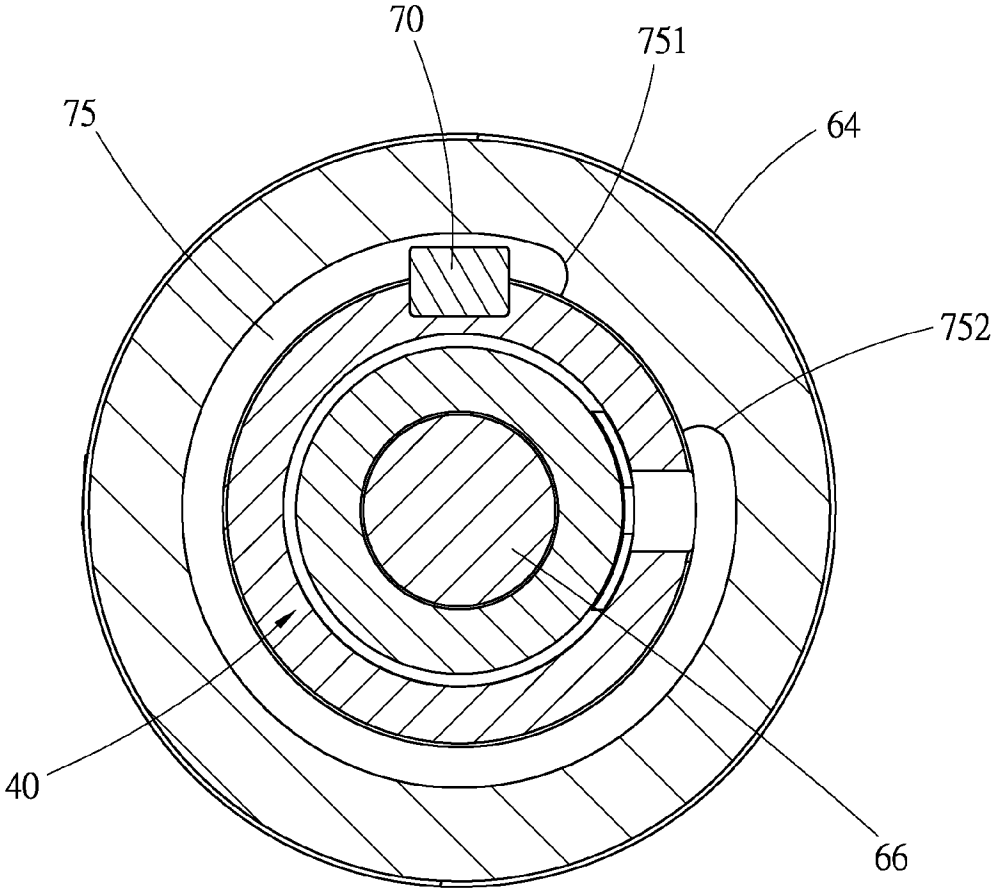
FIG. 7 is a sectional view taken along line 7-7 of FIG. 6.

The adjustment switch 64 of the present invention can be only rotated by a distance shorten than one circle. That is, the rotational angle of the adjustment switch 64 is not over 360 degrees. To achieve this, the present invention further includes a restriction device having a restriction member 70 and a restriction annular groove 75. Please refer to FIGS. 6 and 7. The restriction annular groove 75 is formed on an inner circumference of the adjustment switch 64 and has two closed ends 751, 752. The restriction member 70 is inserted on the tubular body 40. An outer end of the restriction member 70 protrudes from an outer circumference of the tubular body and is inlaid in the annular groove 75. By means of the restriction effect of the two ends 751, 752, the adjustment switch 64 can be only rotated within a range of one circle. It should be noted that the restriction member 70 and the restriction annular groove 75 can be switched in position. That is, the restriction member can be disposed on the circumference of the adjustment switch, while the restriction annular groove can be disposed on the circumference of the tubular body.

The compression spring 52 has an elastic coefficient K. The thread of the threaded rod section 68 has a pitch. In this embodiment, the K value of the spring 52 is 1.5 to 2 times the K value of the spring of the conventional torque wrench of the same rank. The pitch of the threaded rod section 68 of the adjustment rod 66 is 1.3 to 2 times the pitch of the conventional torque wrench of the same rank. For example, in the case that one circle rotation of the handle of the conventional torque wrench leads to an adjustment amount of 10 Nm and the elastic coefficient of the compression spring of the conventional torque wrench is $7878\times10^3$ N/mm$^2$, then the elastic coefficient of the spring 52 of this embodiment is $117\times10^3$ to $156\times10^3$ N/mm$^2$. The pitch of the conventional torque wrench is 2 mm, while the pitch of the threaded rod section 68 of this embodiment is 2.6 to 4 mm. In other words, in this embodiment, the elastic coefficient of the spring and the pitch of the threaded rod section 68 are both larger than that of the conventional torque wrench of the same rank. The above value and time number are only for illustration, not intended to limit the present invention.

By means of increasing the elastic coefficient of the spring and enlarging the pitch of the threaded rod section, a multiplication effect is achieved, whereby within the range of one circle rotation of the handle 64, the elastic coefficient K of the compression spring 52 can be greatly varied. Therefore, the adjustment range of the set torque value (the maximum adjustable torque value to the minimum adjustable torque value) is 1.2 to 10 times. The application range of various wrenches is 1.5 to 3 times. The ratio of a small-size torque wrench can be 2 to 10 times. The ratio of a middle-size torque wrench can be 1.4 to 3 times. The ratio of a large-size torque wrench can be 1.2 to 2.2 times.

Figure 8:
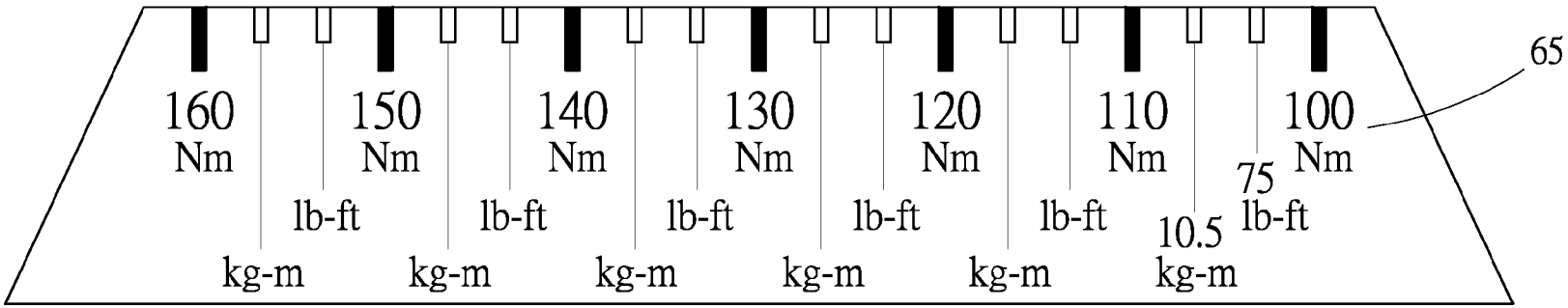
FIG. 8 is a stretched view of the scales marked on the adjustment switch according to FIG. 3.

Please refer to FIG. 8. With this embodiment taken as an example, within the range of one circle rotation of the handle 64, the minimum adjustable torque value is 100 Nm, (where the first end 751 of the restriction annular groove 75 is limited by the restriction member 70), while the maximum adjustable torque value is 160 Nm, (where the second end 752 of the restriction annular groove 75 is limited by the restriction member 70). Therefore, the torque value adjustment range of the wrench 30 is 1.6 times.

Several torque value aspects of the present invention are shown in the following table:

| | minimum torque value (min T) Nm | maximum torque value (max T) Nm | torque value adjustment range (max T/min T) |
|---|---|---|---|
| first aspect | 100 | 160 | 1.6 |
| second aspect | 100 | 200 | 2 |
| third aspect | 50 | 150 | 3 |
| fourth aspect | 20 | 160 | 8 |

In comparison with the conventional torque wrench, the torque wrench of the present invention has the following advantages:

In the conventional torque wrench, when adjusting the set torque value, for example, adjusting the torque value from 100 Nm to 160 Nm, it is necessary to rotate the adjustment switch by several circles such as six circles. In contrast, in the torque wrench of the present invention, the adjustment range can be achieved only by means of rotating the adjustment switch by one circle. Therefore, the torque value can be quickly adjusted.

The present invention is such designed that the adjustment between several often used torque values within a certain range can be achieved only by means of rotating the adjustment switch by one circle. That is, the torque values can be quickly switched. Accordingly, the torque wrench of the present invention is conveniently usable in a site where the operation torque needs to be frequently adjusted, such as an automobile service shop.

Furthermore, as shown in FIG. 8, the circumference of the front end of the adjustment switch 64 is only marked with several scales 65 of often used torque values. The torque value that is aligned with the indicator 41 is right the set torque value. In addition, only several scales 65 of often used torque values are marked so that the scales of different units of torque values can be also marked without crowding. A user still can easily identify the values to precisely adjust the torque of the wrench to a true value.

Figure 9:
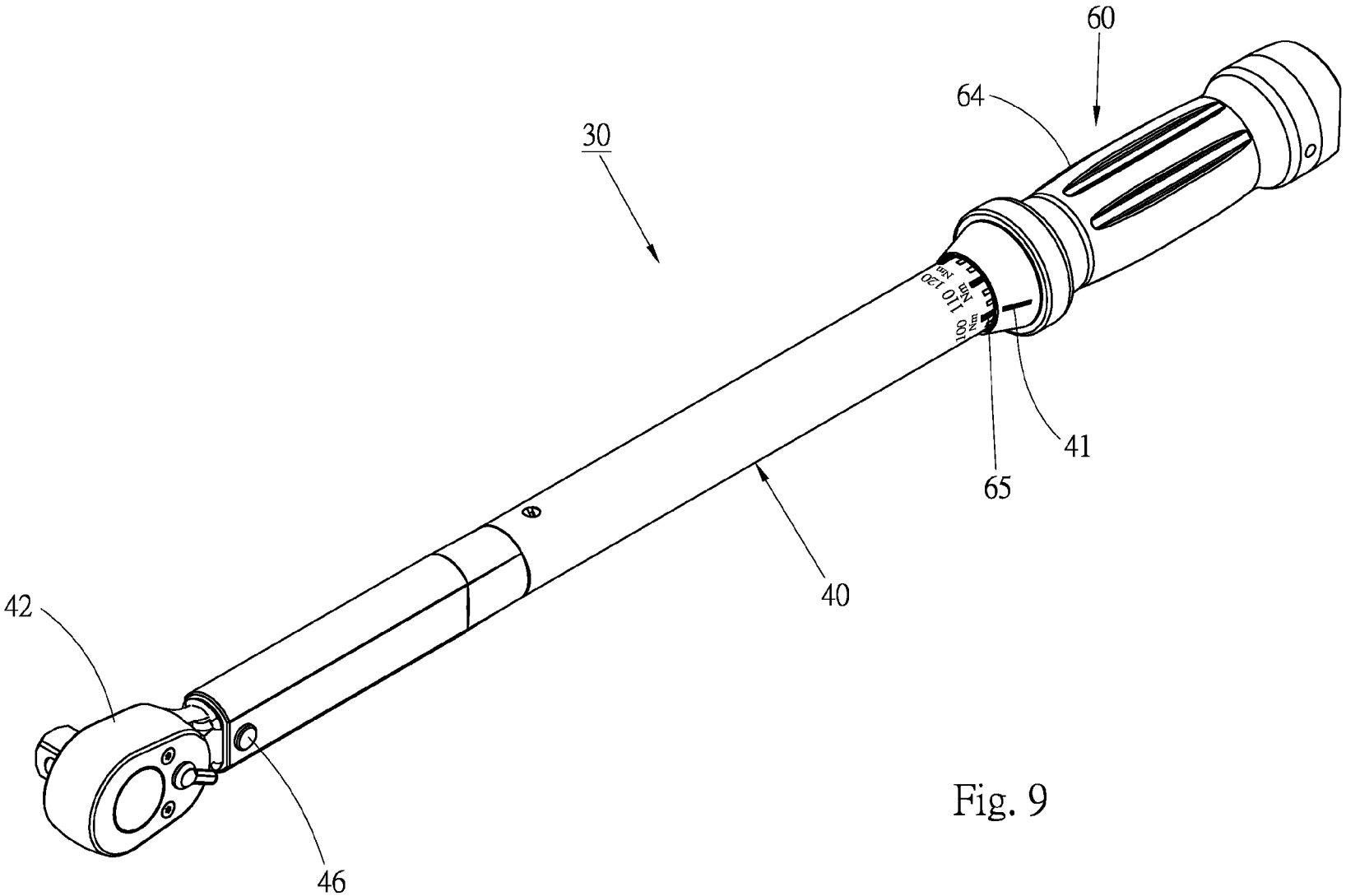
FIG. 9 is a perspective view of a second embodiment of the torque wrench of the present invention.

FIG. 9 shows a second embodiment of the torque wrench 30' of the present invention. The second embodiment is different from the first embodiment in that the scales 65 of torque values are marked on the tubular body 40, while the indicator 41 is disposed on the circumference of the adjustment switch 64.

Figure 11:
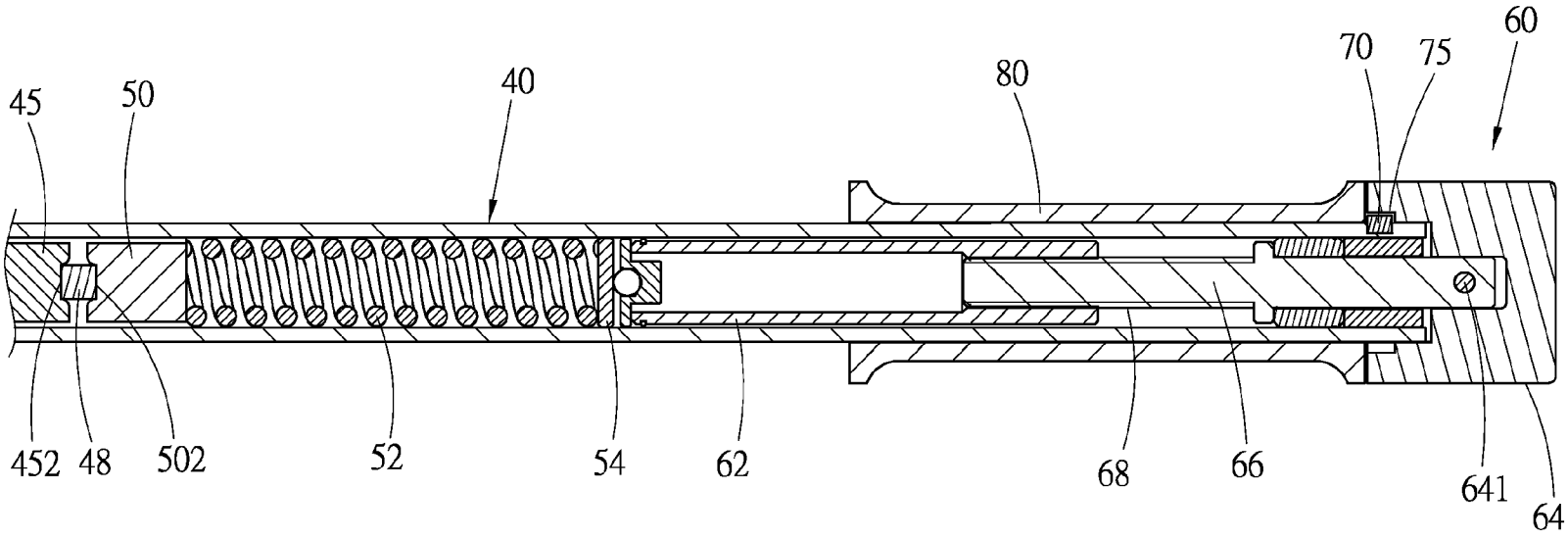
FIG. 11 is a longitudinal sectional view of a part of FIG. 10.

FIGS. 10 and 11 show a third embodiment of the torque wrench 30" of the present invention, wherein the same components are denoted with the same reference numerals and will not be repeatedly described hereinafter.

The third embodiment further includes a handle sleeve 80 mounted on the tubular body 40 and positioned in front of the adjustment switch 64. The adjustment switch 64 is also restricted by the restriction member 70 and the restriction annular groove 75 to only rotate within a range of 360 degrees. The scales 65 of torque values and the indicator 41 are respectively disposed on the circumference of the adjustment switch 64 and the circumference of the handle sleeve 80 for a user to identify the set torque value. Similarly, the scales 65 and the indicator 41 can be switched in position.

In this embodiment, the rear end of the flexible bar 45 is formed with a first recess 452 and the front end of the abutment member 50 is formed with a second recess 502. An abutment block 48 is positioned between the two recesses. The detachment mechanism is composed of the first and second recesses 452, 502 and the abutment block 48.

In conclusion, the torque values of the torque wrench of the present invention can be easily and quickly switched and a user can clearly identify the torque values to adjust the torque of the wrench to a true value.

The above embodiments are only used to illustrate the present invention, not intended to limit the scope thereof. Many modifications of the above embodiments can be made without departing from the spirit of the present invention.

What is claimed is:

1. A fast torque-adjustable torque wrench comprising:

a tubular body;

a head section positioned at a front end of the tubular body; a flexible bar pivotally disposed at the front end of the tubular body and swingtable, a rear end of the flexible bar being positioned in the tubular body; the head section being fixedly connected with a front end of the flexible bar;

an abutment member and a compression spring disposed in the tubular body, the abutment member being positioned behind the flexible bar and movable within the tubular body; a front end of the compression spring elastically abutting against the abutment member;

a detachment mechanism formed between the rear end of the flexible bar and the front end of the abutment member;

a torque adjustment mechanism including an adjustment rod and an adjustment switch, the adjustment rod being disposed in the tubular body, the adjustment rod being formed with a threaded rod section having a thread; the adjustment switch being rotatably disposed at the rear end of the tubular body and connected with a rear end of the adjustment rod, whereby when rotating the adjustment switch, the adjustment rod is rotated along with the adjustment switch to adjust the elastic force of the compression spring against the abutment member; and a restriction device located between the tubular body and the adjustment switch; the adjustment switch being restricted by the restriction device to only rotate within a rotational angle that is less than 360 degrees;

wherein the adjustment switch being only rotatable within the rotational angle that is less than 360 degrees, in the rotational angle of the adjustment switch, the wrench having a minimum adjustable torque value and a maximum adjustable torque value within the rotational angle of the adjustment switch, the ratio of the maximum adjustable torque value to the minimum adjustable torque value ranging from 1.2 times to 10 times;

wherein the restriction device comprising a restriction member and a restriction annular groove respectively disposed on an outer circumference of the tubular body and an inner circumference of the adjustment switch, the restriction annular groove having two ends, one end of the restriction member being inlaid in the restriction annular groove; the restriction member is inlaid in the restriction annular groove in a radial direction of the tubular body and the adjustment switch.

2. The torque wrench as claimed in claim 1, wherein the ratio of the maximum adjustable torque value to the minimum adjustable torque value is achieved by means of the elastic coefficient of the compression spring or the pitch of the threaded rod section or the cooperation relationship between the elastic coefficient of the compression spring and the pitch of the threaded rod section.

3. The torque wrench as claimed in claim 1, wherein the ratio of the maximum adjustable torque value to the minimum adjustable torque value ranges from 1.5 times to 3 times.

4. The torque wrench as claimed in claim 1, wherein the adjustment rod is only rotatable within the tubular body without possibility of axially moving within the tubular body, the torque adjustment mechanism further including a slide member movably disposed in the tubular body, a front end of the slide member abutting against the rear end of the compression spring, the threaded rod section of the adjustment rod being screwed with a rear end of the slide member.

5. The torque wrench as claimed in claim 1, wherein the restriction member is disposed on the outer circumference of the tubular body, while the restriction annular groove is disposed on the inner circumference of the adjustment switch.

6. The torque wrench as claimed in claim 1, further comprising several scales of torque values and an indicator respectively disposed on the circumference of the adjustment switch and the circumference of the tubular body corresponding to each other.

7. The torque wrench as claimed in claim 1, further comprising a handle sleeve fitted on the tubular body and positioned in front of the adjustment switch and further comprising several scales of torque values and an indicator respectively disposed on the circumference of the adjustment switch and the circumference of the handle sleeve corresponding to each other.

* * * * *